United States Patent [19]

Lapes

[11] 4,043,631

[45] Aug. 23, 1977

[54] ELECTRICAL TERMINAL STRUCTURE FOR CONNECTOR

[75] Inventor: Rubin Lapes, Los Angeles, Calif.

[73] Assignee: Hollingsead-Pryor Enterprises, Los Angeles, Calif.

[21] Appl. No.: 679,986

[22] Filed: Apr. 26, 1976

[51] Int. Cl.[2] ..... H01R 13/06

[52] U.S. Cl. ..... 339/252 R; 339/48; 339/217 S

[58] Field of Search ..... 339/47–49, 339/75, 217, 252

[56] References Cited

U.S. PATENT DOCUMENTS 3,587,037 6/1971 Anhalt ..... 339/75 M

FOREIGN PATENT DOCUMENTS 2,020,077 11/1971 Germany ..... 339/217 S

*Primary Examiner*—Joseph H. McGlynn

*Attorney, Agent, or Firm*—Jackson & Jones

[57] ABSTRACT

An electrical contact, or terminal, structure is disclosed, which is designed for use in an electrical connector device. The terminal structure is a generally flat conducting element, preferably a unitary metal stamping, having a contact end which is resiliently deflectible by a force normal to the plane of the element, and having spaced-apart, longitudinally extending side portions, or branches, which are resiliently deflectible toward one another in the plane of the element to permit their insertion into and automatic locking in place in a terminal supporting member, such as a molded insulating insert, or block, mounted in either the male or female shell of an electrical connector device.

6 Claims, 8 Drawing Figures

ELECTRICAL TERMINAL STRUCTURE FOR CONNECTOR

BACKGROUND OF THE INVENTION

This invention relates to contact elements, or terminals, which are inserted in electrical connectors to provide the electrically-conducting elements which are brought into engagement with complementary electrically-conducting elements when the connector mating portions are brought into mated position. The invention is primarily, although not exclusively, concerned with improved terminals for connectors of the low, or zero, insertion force type. Such connectors generally work on the principle of bringing the opposed terminal elements into overlying but nonengaging position as the connector portions are moved together, and thereafter causing relative transverse movement of the opposed terminal elements to bring them into engagement with one another.

As set forth in Hollingsead and Pryor Application Ser. No. 535,307, filed Dec. 23, 1974, and assigned to the assignee of this application, numerous prior art patents have dealt with the problem of providing the most satisfactory terminal, or electrical contact, elements for electrical connectors, printed circuit boards, and the like. Reference to that application will provide a list of patents supplied both by the applicant and by the Patent Office.

The state of relevant art, insofar as the present applicant is aware, is well represented by the terminal element structures shown in the following patents: Mishelevich et al U.S. Pat. No. 3,145,067; Walkup U.S. Pat. No. 3,683,317; Schneck U.S. Pat. No. 3,351,891; Anhalt U.S. Pat. No. 3,587,037; Pistey U.S. Pat. No. 3,324,447; Krehbiel U.S. Pat. No. 2,938,190; Greco et al U.S. Pat. No. 3,160,459; and Collier et al U.S. Pat. No. 3,880,488.

Some of the attributes required by terminal elements for electrical connectors, which are present in the invention herein set forth as well as the prior art are: ease of insertion, automatic locking in place, good retention along with simple removability when required, interchangeability in use in either the male or female portion of the connector, and strength combined with sufficient resilience to insure effective electrical contact by permitting resilient deflection in engaging, or contact, position.

Some of the attributes possessed by the present invention, which are believed to constitute benefits not provided as well by the prior art are:

a. Reduction to a minimum of air space around the terminal element after it has been installed in the passage, or channel, in the insulating support member. One of the significant problems encountered in electrical connectors is loss of electrical conducting efficiency due to corrosion and similar difficulties. These difficulties are caused in part by contaminants carried by the air which reaches the terminal elements and their contact points. The forced air cooling often provided for electronic modular units and other electronic components greatly accelerates this corrosion process if substantial amounts of air move through the connector passages in which the terminal elements are mounted.

b. Unusually good support for the terminal element in the insulating support member. This invention provides a terminal element structure which has a particularly well-supported engagement with the walls of the passage into which the terminal element is inserted.

c. Reduced likelihood of failure or dislodging of the terminal element, an advantage provided by a redundancy concept which involves duplicating the electrical conducting path and duplicating the means for locking, or retaining, the terminal element in its channel, or passage; so that breakage of one of the redundant portions of the terminal element will not destroy its functional effectiveness.

d. Manufacturing simplicity and process-conscious design which permits the terminal elements to be made by a series of automatically controlled press-forming, or stamping, steps. The structure is such that it can be manufactured in a series of press forming stations, starting with a punch press into which a metal ribbon is fed. This manufacturing simplicity permits the use of a process which is both reliable and cost effective.

e. Insertion and extraction simplicity, including specific advantages, such as positive prevention of accidental insertion of the terminal element upside down, and reduced tendency of the terminal element, when it is being removed, to tear the rubber seal associated with the opening into the back of the connector shell through which the electrical wires pass.

f. Better design for the connection of an electric wire to the outer end of the connector, including means for assisting in properly positioning the end of the wire prior to crimping the terminal element flanges into wire-gripping position.

SUMMARY OF THE INVENTION

The terminal element structure which provides the foregoing advantages preferably comprises a unitary, generally flat, resilient metal body having wire-en flanges at one end; a contact portion at the other end which is deflectible, when it engages with a complementary contact, in a direction normal to the plane of the body; and, most importantly, two longitudinally-extending generally parallel branches intermediate the ends of the body, each of which is resiliently deflectible in the plane of the body as the terminal element is inserted or extracted from its enclosing channel, or passage, and each of which provides an independent means for both (a) conducting electrical energy lengthwise of the terminal element and (b) engaging a complementary portion in the channel wall in such a way as to retain the terminal element in its proper position in the channel. Not all of the concepts enumerated in the preceding sentence need to be incorporated in a given structure in order to constitute a structure which is inventively different from the prior art; in other words, the enumerated concepts may be claimed independently or in various subcombinations.

BRIEF DESCRIPTION OF THE DRAWINGS

FIG. 2 is a vertical, part-sectional view showing the two terminal elements in overlying but non-contacting positions. FIG. 3 is also a vertical, part-sectional view, but it shows the two terminal elements in contact with one another. FIG. 4 is a horizontal view, partly in section, which provides a plan view of the terminal elements;

DETAILED DESCRIPTION OF THE PREFERRED EMBODIMENT

Figure 1:
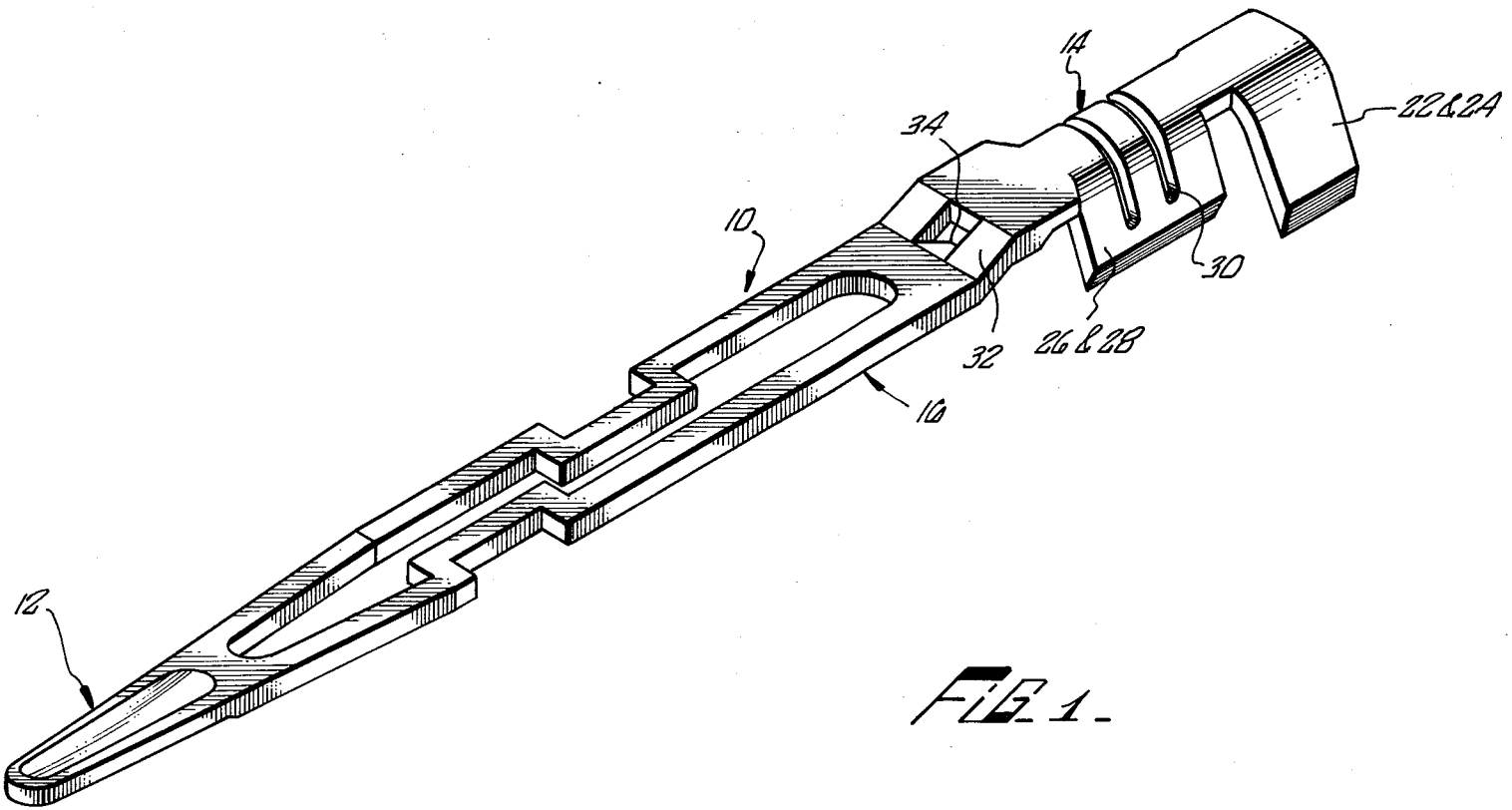
FIG. 1 is a view, in perspective, of a terminal, or contact, element illustrating the preferred embodiment of the invention. In the figure, the fully formed terminal element is shown prior to its insertion in the insulating supporting block and prior to its attachment to the electrical wire which it leads into the connector.

Referring first to FIG. 1, we can conveniently characterize the terminal element 10 as having generally three portions: a contact portion 12 at one end, a wire engaging portion 14 at the other end, and an intermediate connecting portion 16 which fits into the passage in which the element is retained and holds it in position after installation.

Figure 2:
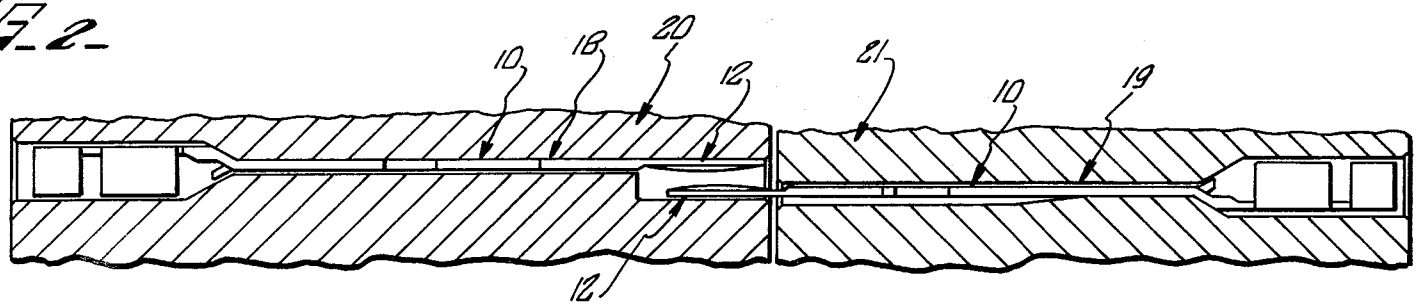
FIGS. 2 through 4 show partial sectional views of the assembled electrical connector, in which two opposing terminal elements, of the type shown in FIG. 1, are installed.
Figure 3:
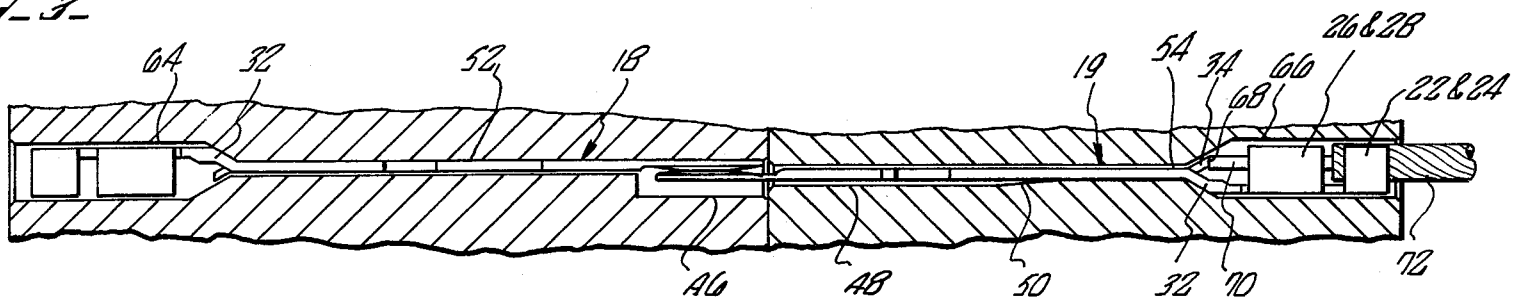
Figure 4:
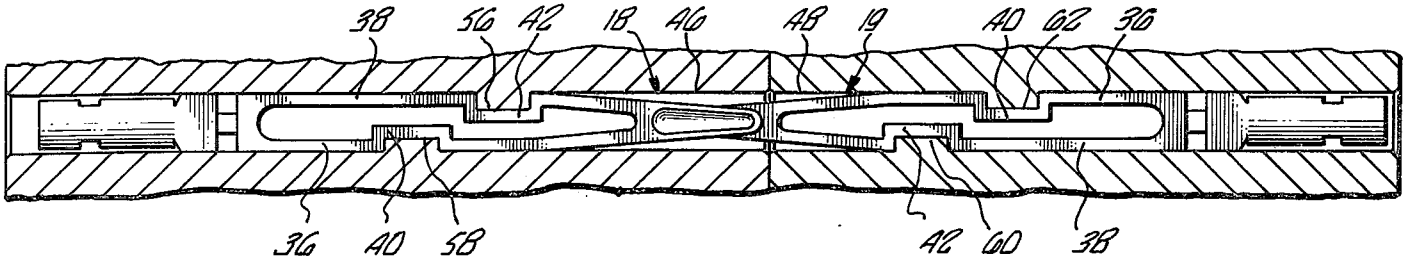
Figure 5:
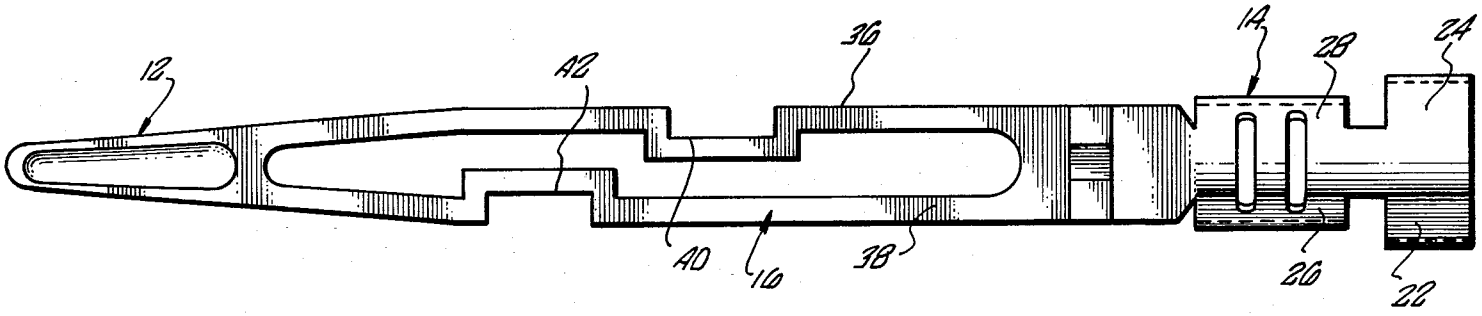
FIG. 5 is a plan view of one of the terminal elements prior to installation.
Figure 6:
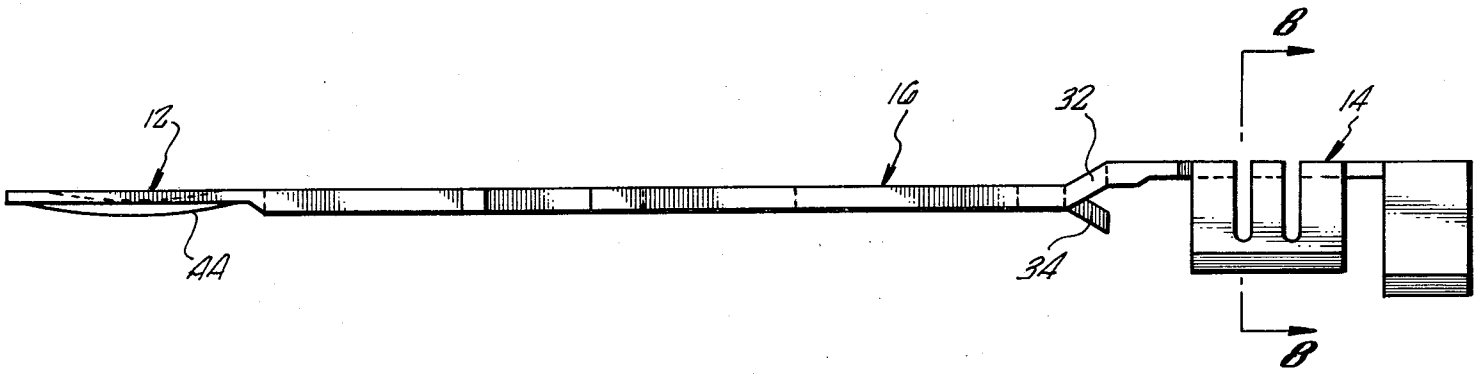
FIGS. 6 and 7 are side and end views, respectively, of the terminal element of FIG. 5.

Before discussing the structure of element 10 in greater detail, reference to FIGS. 2 to 4 is made to illustrate the environment in which terminal elements of this type are intended to be used. In FIGS. 2 to 4, two opposed identical terminal elements 10 are shown in their installed positions. Each of the elements 10 extends through one of the channels, or passages, 18 and 19 provided in one of the two insulating support members, 20 and 21. The insulating support members 20 and 21 are molded blocks of suitable dialectrical material, each of which is preferably mounted in a metal shell which constitutes one mating portion of a two-part electrical connector. The two shells are a plug and receptacle, or male and female, combination when the electrical connector is assembled.

In their respective positions in FIG. 2, the two terminal elements 10 are out of engagement with one another because their support members 20 and 21 are in the relative positions shown. In FIG. 3, the terminal elements 10 are engaged with one another as a result of relative motion between the two supporting members 20 and 21. As previously stated, it is preferable that the inter-engaging contact, or terminal, elements 10 be identical, thus simplifying manufacture and inventory problems. The only difference in the arrangement of the two opposed terminal elements 10 is that their positions are reversed, i.e., the one in support member 20 is upside-down with respect to the one in support member 21. The passages 18 and 19 in the two support members differ in certain respects, which will be discussed in detail below.

Figure 7:
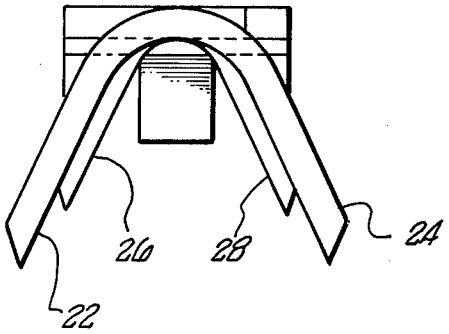
Figure 8:
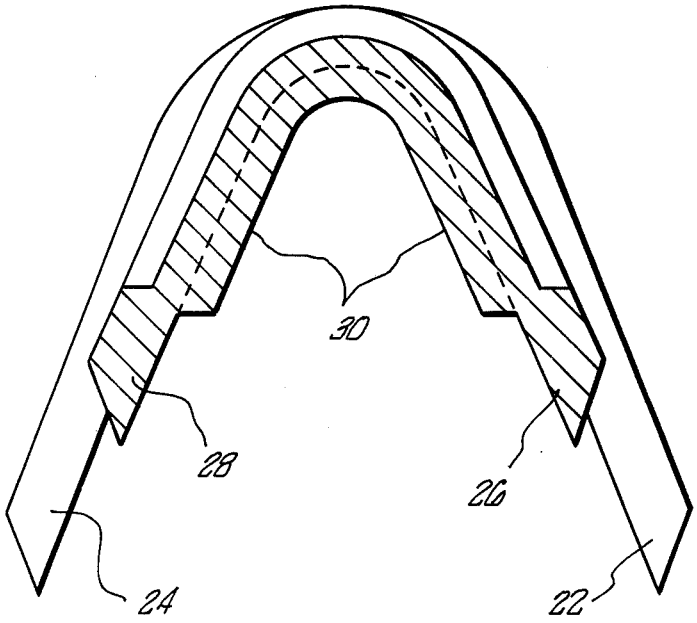
FIG. 8 is a sectional view taken on the line 8—8 of FIG. 6.

Proceeding now to a detailed description of each terminal element 10, and referring to all of the figures (except where attention is expressly called to specific figures), we see that the wire engaging portion 14 of element 10 has two sets of crimping flanges which curve away from the original plane of the metal blank from which the element was formed. At the very end of element 10, two oppositely extending flanges 22 and 24 are provided for crimping onto the insulation surrounding the electric wire conductor. Spaced a short distance from the crimping flanges 22 and 24 are two separate crimping flanges 26 and 28, which are adapted to crimp onto the conducting wire. Gripping ridges 30 (see FIG. 8) may be formed on the inside of the wire crimping flanges 26 and 28 in order to improve the wire retention effect of those flanges. As seen in the end view (FIG. 7) and in the cross-section (FIG. 8), the wire gripping flanges 26 and 28 are initially partially crimped on a smaller radius than the insulation gripping flanges 22 and 24.

As seen in the side views of terminal element 10, the inner end of its wire-engaging portion 14 has a sloping portion 32 which leads into the flat intermediate connecting portion 16 of the terminal element. Also a lance, or projection, 34 is formed to slope in the opposite direction from the end of portion 16.

The intermediate connecting portion 16 of terminal element 10 has two laterally-spaced branches, or generally parallel sides, 36 and 38 which extend longitudinally between the wire engaging portion 14 and the electrical contact portion 12 of the terminal element. Each of the branches 36 and 38 is formed to provide a wall-engaging indentation. Branch 36 has an indentation 40 and branch 38 has an indentation 42. The indentations 40 and 42 are longitudinally spaced from one another, so that they will not interfere with deflection of the two branches 36 and 38 toward one another as the terminal element is inserted into its channel in the insulating support member.

The contact end portion 12 of each terminal element preferably has a slightly raised convex engaging surface 44 which contacts the engaging surface 44 of the opposing terminal element when the two are brought into engagement, as shown in FIG. 3.

FIGS. 2 - 4 show the shapes of the channels, or passages, 18 and 19. Although only one pair of channels 18 and 19 is shown in the figures, it will be readily understood that the molded insulating support members 20 and 21 normally are provided with a large number of such channels. The cross-sections of the channels 18 and 19 are generally rectangular because the terminal elements are of the "reed" type, i.e. their engagement with one another is side-to-side engagement resulting from relative transverse motion of the support members 20 and 21, rather than relative telescoping motion, as in the case of pin-and-socket terminals.

The inner ends of channels 18 and 19 are different, in that channel 18 has a vertically deeper end opening 46, whereas channel 19 has a vertically shallower end opening 48 which slopes upwardly at 50. Each of the channels 18 and 19 has a shallow intermediate portion which is vertically very narrow, only slightly larger than the thickness of the intermediate portion 16 of the terminal element 10. The shallow intermediate portion 52 of channel 18 is substantially longer than the shallow intermediate portion 54 of channel 19 because of the length of the opening 48 in channel 19.

The reason for these differences is apparent in FIGS. 2 and 3 because the larger vertical dimension of inner opening 46 in channel 18 permits the terminal element 10 which protrudes from the inner end of channel 19 to extend into the opening 46. In FIG. 2, the contact portions 12 of the opposed terminal elements are in overlapping (or overlying) but non-contacting position. In FIG. 3, the contact portions 12 of the opposed terminal elements 10 are in engagement as a result of relative vertical, or transverse, movement of their supporting members 20 and 21. In engaging position, the upper flat side of the terminal element in channel 18 is pressed against the top of opening 46, whereas the contact portion of the terminal element in channel 19 is deflected downwardly toward the bottom of opening 48. Obviously, this slight resilient deflection of the contact portion of at least one of the terminal elements is necessary in terminal engaging position in order to insure good electrical contact, providing a resilient pressure between the terminals, and compensating for any variations in spacing between terminals due to manufacturing tolerances.

Referring to FIG. 4, which is a plan view of the interengaging terminal elements 10, it is apparent that each channel 18 and 19 has two projections which engage the indentations formed in the separate deflectible branches of the terminal elements 10. Channel 18 has a projection 56 formed in one side thereof located nearer the inner end of opening 46, and a projection 58 formed in the other side thereof located farther from the inner end of opening 46. Channel 19 has a projection 60 formed in one side thereof located nearer the inner end of opening 48, and a projection 62 formed in the other side thereof located farther from the inner end of opening 48. The inner and outer projections in channels 18 and 19 are reversed, i.e., as seen in FIG. 4, the inner (nearer opening 46) projection 56 is in the upper portion of the figure, and the inner (nearer opening 48) projection 60 is in the lower portion of the figure, whereas the more remote projections 58 and 62 are located, respectively, in the lower and upper portions of the figure. This arrangement insures that no terminal element can be inadvertently mounted upside down in its supporting member. If it were accidentally inserted upside down, it would not lock in position with its wire-engaging portion 14 protruding from the supporting member.

The outer openings 64 of channel 18 and 66 of channel 19 are adapted to receive the enlarged wire-engaging end portions 14 of the terminal elements.

Installation of the terminal elements 10 in the channels provided in their supporting members is preceded by connection of each terminal to its electrically conducting wire. This is accomplished by first placing the end 68 of the wire 70 against the projection 34 which provides a convenient locating stop for the wire, and then using a suitable crimping tool to crimp flanges 26 and 28 onto the exposed portion of wire 70 and to crimp flanges 22 and 24 onto wire-covering insulation 72.

After connection of each terminal element to its wire conductor, the terminal element is ready to be pushed into its channel. As the terminal element is inserted, the spaced sides or branches 36 and 38 of its intermediate portion 16 deflect toward one another to permit continued insertion, until the terminal element reaches its fully inserted position. When the fully inserted position is reached the forward indentation 42 in branch 38 coincides in longitudinal location with the forward projection 56 or 60 in the channel wall, and the rearward indentation 40 in branch 36 coincides in longitudinal location with the rearward projection 58 or 62 in the channel wall. As soon as this position is reached, the inherent resilience of the branches 36 and 38 causes them to spring outwardly with their indentations fitting over the projections in the channel wall, thereby automatically holding the terminal element in its inserted position. If it subsequently becomes necessary to remove the terminal element from its channel, a suitable tool can be inserted from the inner end of the channel to deflect the branches 36 and 38 toward one another sufficiently to cause the indentations to disengage the projections and permit removal of the terminal element.

The locking, or holding, interengagement of the projections and indentations would function just as well if their orientation were reversed by providing indentations in the channel walls and projections extending laterally from the resilient branches of the terminal element.

From the foregoing description, it is doubtless apparent how the novel benefits of this invention are provided. However, a brief recapitulation may be desirable.

a. The air space around the terminal element installed in its channel has been reduced to a minimum. The only throughflow air space is the slight installation tolerance space between the intermediate portion 16 of the opposed terminal elements and the shallow intermediate portions 52 and 54 of channels 18 and 19. (See FIGS. 2 and 3).

b. The unusually effective support for each terminal element in its channel is clear from the showing. A broad horizontal engaging surface is provided, and the side engagement insures effective retention.

c. Each of the spaced, generally parallel braches 36 and 38 provides both (a) an independent electrical path between the conducting wire and the contact portion of the terminal element, and (b) an independent resilient means of holding the terminal element in its inserted position. This design thus provides functional redundancy to insure against terminal failure or accidental dislocation.

d. The invention permits efficient and reliable manufacturing of the terminal elements by a series of press forming steps. It is readily apparent that the terminal element structure is readily easy to manufacture, and does not involve any abnormally difficult steps.

e. Referring to insertion and extraction simplicity, as previously explained, accidental insertion of a terminal element upside down would be immediately apparent because it would protrude from its channel. Also, during removal the terminal element is less likely to damage a rubber seal around the end of the conducting wire.

f. The simplified attachment of the conducting wire to the outer end of the terminal element is primarily due to the design which permits projection 34 to function as a locating stop for the end of the wire, thereby simplifying the design and operation of the crimping tool.

The following claims are intended to cover the full scope of applicant's contribution to the art, and should be interpreted in the light of the appropriate range of equivalency beyond the specific preferred structure disclosed.

What is claimed is:

1. A contact element, for use in an electrical connector having a support member providing an internal passage, comprising:

an elongated, generally flat, resilient, unitary metal body, the first end of which is adapted to be in electrical contact with a wire and the second end of which is adapted to contact another contact element, the second end of said body being brought into electrical contact by movement in a direction not in the plane of the body and having sufficient resilience to deflect away from said plane when in contact, the intermediate portion of the body having two longitudinally extending side branches separated by a space therebetween and each having an externally facing indentation adapted to engage complementary projections provided in the passage in the support member, each indentation having a pair of oppositely facing shoulders, the indentations of the two branches being longitudinally spaced from one another, each of said side branches having sufficient resilience to deflect in the plane of the body toward the other wall to permit its longitudinal motion into the passage until its indentation coincides with the complementary projection, whereupon its resilience automatically causes its indentation to interlock with the projection.

2. A terminal element, for use in an electrical connector having one or more passages for retaining such an element, said element comprising:

an at least partially resilient body adapted to be inserted into and removed from such a passage, said body having a contact portion near one end thereof adapted to be brought into electrical contact with another terminal element by motion in a given direction, said body having two parallel deflectible portions which deflect in opposite directions in the plane of the parallel deflectible portions during insertion of the body into, or its removal from, the passage, each of said deflectible portions having two oppositely facing shoulders which are adapted to engage complementary shoulders in the passage, and both shoulders of one of the deflectible portions being longitudinally closer to one end of the body than both shoulders of the other deflectible portion.

3. The terminal element of claim 2 wherein the contact portion of the body is deflectible in the direction of contact-engaging motion.

4. The terminal element of claim 2 wherein the body is a press-formed unitary element.

5. The terminal element of claim 2 wherein the end of said body opposite said contact portion comprises:

first gripping means adapted for holding insulation of a wire; and second gripping means adapted for holding the conductive portion of a wire.

6. The terminal element of claim 5 further comprising a projection located toward the contact portion of said body, slightly beyond said second gripping means, for preventing the conductive portion of a wire from extending beyond the projection.

* * * * *